United States Patent [19]

Alleman

[11] Patent Number: 4,659,521

[45] Date of Patent: Apr. 21, 1987

[54] METHOD FOR CONDENSING A GAS IN A LIQUID MEDIUM

[75] Inventor: Carl E. Alleman, Bartlesville, Okla.

[73] Assignee: Phillips Petroleum Company, Bartlesville, Okla.

[21] Appl. No.: 860,696

[22] Filed: May 5, 1986

Related U.S. Application Data

[63] Continuation of Ser. No. 717,352, Mar. 29, 1985, abandoned.

[51] Int. Cl.[4] ..... B01F 3/04

[52] U.S. Cl. ..... 261/123; 261/DIG. 76; 261/DIG. 10

[58] Field of Search ..... 261/DIG. 76, 123, DIG. 10, 261/DIG. 32

[56] References Cited

U.S. PATENT DOCUMENTS

| | | | |
|---|---|---|---|
| 374,346 | 12/1887 | Coats | 261/123 |
| 631,363 | 8/1899 | Ferreira . | |
| 1,401,535 | 12/1921 | Gross et al. | 261/123 |
| 1,992,352 | 2/1935 | Cameron | 261/123 |
| 2,093,895 | 2/1936 | Mojonnier et al. . | |
| 2,094,778 | 10/1937 | Alexander | 261/123 |
| 3,923,483 | 12/1975 | Hilmer et al. | 55/463 |
| 4,172,009 | 10/1979 | Simon et al. | 261/123 |
| 4,234,560 | 11/1980 | Kuerten et al. | 423/659 |
| 4,252,611 | 2/1981 | Mizumachi et al. | 176/38 |
| 4,394,139 | 7/1983 | Board | 55/20 |
| 4,399,082 | 8/1983 | Becker et al. | 261/124 |
| 4,446,081 | 5/1984 | Arinobu | 261/64 |
| 4,477,341 | 10/1984 | Schweiss et al. | 209/170 |
| 4,534,862 | 8/1985 | Zlokarnik | 261/123 |

FOREIGN PATENT DOCUMENTS

| | | | |
|---|---|---|---|
| 228773 | 11/1910 | Fed. Rep. of Germany | 261/123 |
| 49844 | 1/1941 | Netherlands | 261/123 |
| 263506 | 1/1927 | United Kingdom | 261/123 |

OTHER PUBLICATIONS

Bathija, Prakash, J., "Jet Mixing Design and Application", Chemical Engineering, Dec., 1982.

*Primary Examiner*—Tim Miles

*Attorney, Agent, or Firm*—French and Doescher

[57] ABSTRACT

A method for condensing a gas in a liquid medium to prevent the formation of gas hammer, comprising impinging a gas against a plate at such a velocity so as to cause the gas to fan out in a thin sheet before condensing in the liquid medium.

10 Claims, 2 Drawing Figures tance is that which will effect the purpose of the invention to impinge the gas on the plate so as to allow the gas to fan out in a thin sheet before condensing in the liquid medium.

The plate used in the invention is preferably flat and preferably aligned perpendicular to the orifice of the instant invention. Further, the plate can be disposed in the liquid medium in any manner suitable to allow the gas exiting the orifice to impinge on the plate so as to allow the gas to fan out in a thin sheet before condensing in the liquid medium.

Referring to FIG. 1, a gas from a gas containment vessel 2 is discharged through conduit 4 to an external gas inlet 6 of a liquid containment vessel 8. The gas is subsequently passed from the external gas inlet 6 of the liquid containment vessel 8 by means of conduit 10 to an orifice 14 and plate 20 positioned below the level of liquid medium contained in the liquid containment vessel 8. Attached to conduit 10 by means of a plurality of rods 16 and 18 is a plate 20 which is submerged in the liquid medium. Gas from conduit 10 will pass through the orifice 14 and directly impinge on the plate 20, thereby breaking up the gas-stream and causing the resultant tiny gas bubbles to fan out in a thin sheet of gas prior to condensing in the liquid medium.

FIG. 2 details one embodiment of a means for impinging a plate with a gas prior to the gas condensing in a liquid medium.

Gas from conduit 10 will pass through an orifice 14 and directly impinge on the plate 20. The plate is attached by means of rods 16 and 18 to a bar-stock cap 22. The cap is threaded and wedged to the threaded walls 11 on the conduit 10 so as to ensure a complete seal. The cap also houses the orifice 14. As shown, orifice 14 is a relatively restricted orifice in a transverse wall of cap 22 which closes the end of conduit 10. The end of conduit 10 defines an opening which is of substantially larger cross-section than the orifice. The gas will impinge on plate 20, thereby breaking up the gas-stream and causing the resultant tiny gas bubbles to fan out in a thin sheet prior to condensing in the liquid medium.

EXAMPLE 1

A 42"×40" boiler feed water (BFW) tank is utilized to feed water to a 8,000 lb/hr., 150 psig steam boiler. The boiler feed tank also serves the dual purpose of heating well water to at least 227° F. (5 psig) in order to (a) keep on adequate suction pressure on the boiler feed water pumps and to (b) minimize the thermal shock to the boiler when makeup water from the well was being fed to the boiler. The maximum heating requirement for the BFW tank occurs when heating oil for discharge from a barge, at which time there is no condensate return. At that time 6,000 lb/hr of well water is heated, including the amount required for blowdown. This requires the direct injection into the BFW tank of about 1070 lb/hr of 150 psig steam for heating.

The 150 psig steam is regulated to 70 psig before entering the BFW tank, since the BFW tank has a design pressure of 86 psig. The steam entering the 150-gallon pool of water in the BFW tank will have a volume-rate of 6.6 cubic feet per second.

In the installed 2" diameter pipe the steam has a velocity of about 285 ft/sec (194 miles per hour). It is normally impossible to adequately mix this large volume of steam at such a high velocity in such a small pool of water without totally disrupting the pool of water and thereby rendering the level control devices utterly useless. Further, the arrangement of the overall system precluded the possibility of heating the cold water before it entered the BFW tank. Thus, the steam had to be contacted with the pool of cold water, but without significant steam hammer.

In order to allow the steam to condense in the liquid medium, the steam was impinged against a plate so as to cause the steam to fan out in a thin sheet before condensing in the water. This eliminated the problem of steam hammer and disruption of the water pool which otherwise would have been experienced when introducing that amount of steam into the water.

EXAMPLE 2

Calculated Example 2 utilizes a multi-stage compressor, such as in refrigeration systems, in which it is essential that the rate of flow through the compressor not drop to too low a value. If too low a flow occurs, the compressor will go into surge and is apt to damage itself and other equipment. When the thruput for the compressor starts getting too low, artificial arrangements are resorted to in order to keep the total flow through the compressor up above its minimum allowed. To accomplish this, some sort of recycle of the gas is used. Since much energy goes into the gas during compression, the gas that is recycled must be cooled. One approach for cooling is to put this gas through an air-cooled exchanger or a water-cooled heat exchanger. However, in many refrigeration systems, e.g., where ethylene is the refrigerant, the water or air is not cool enough to accomplish the cooling needed for the first stage or two of compression. For this reason, a stream of liquid ethylene is brought back from the compressor's discharge accumulator to do the cooling. Direct contact (between the liquid and the hot gas stream) is accomplished by "bubbling" the gas up through a pool of liquid. Thus, the heat of compression is taken up by vaporizing some of the liquid. In this example, the present invention could be used advantageously (for reasons which follow) in contacting this gas with the liquid that is to be vaporized. In normal operation the gas is not totally condensed, but merely cooled. However, when the recycle stream is just starting to flow and the piping hasn't yet been heated up, the gas often enters the pool of liquid cool enough to be totally condensed by the liquid. Under these circumstances the device of the present invention would be applicable and very beneficial to eliminate very significant gas hammer (ethylene hammer).

EXAMPLE 3

Calculated Example 3 indicates that in certain fixed bed dehydrator systems, a liquid hydrocarbon is passed downward through a particulate bed of desiccant in order to remove the dissolved water. When the bed has reached its capacity for water, it must then be regenerated to keep the moisture from going downstream. When dehydrating liquid propane, for example, it is desirable to regenerate the bed with propane vapors, rather than using some other gas, such as methane for the regenerant and thereby contaminating the propane. When the regeneration step commences, a stream of hot propane vapors is generated in a heat exchanger and introduced to the top of the dehydrator vessel. The liquid that is in the vessel is then pushed out through the bottom of the vessel. This is an undesirable situation because the liquid will soon be followed by hot gases, and it is impractical to handle both the liquid and vapor

METHOD FOR CONDENSING A GAS IN A LIQUID MEDIUM

BACKGROUND OF THE INVENTION

This application is a continuation of application Ser. No. 717,352, filed Mar. 29, 1985, now abandoned.

The invention relates to a method for condensing a gas in a liquid medium. It further relates to a method for condensing a gas-stream in a liquid medium so as to prevent the generation of significant gas hammer. In one embodiment of the invention steam is condensed in water in such a manner so as to prevent the generation of significant steam hammer.

The process of condensing a gas in a liquid medium can cause the formation of large bubbles as gas is introduced into the liquid medium. The generation of such large bubbles can be detrimental to the uniform mixing of the gas in the liquid medium and cause significant generation of gas hammer as it condenses in the liquid medium. One such example is the generation of a steam hammer as steam condenses in water. Steam hammer occurs when bubbles of steam condense suddenly so as to cause the slugs of water on each side of the bubbles to slam against each other. The generation of steam hammer is potentially both noisy and damaging. The generation of the steam hammer in a large conduit can eventually cause the conduit to rupture, cause damage to insulation and additional appurtenances of the conduit, and/or cause a continuous, unpleasant, loud noise to be emitted from the conduit.

In order to overcome the problems associated with condensing a gas in a liquid medium, the present invention utilizes a plate submerged in the liquid medium and means for impinging the gas against the plate, thereby breaking up a large stream of gas and causing the resultant tiny bubbles of gas to fan out in a thin sheet of gas before condensing in the liquid medium. This invention will prevent the generation of significant gas hammer normally encountered with large volumes of gas condensing in a liquid medium. The invention is such that it will prevent the generation of significant steam hammer even under conditions when the gas-stream is relatively large and the gas-stream is subjected to only a minor pressure drop.

It is therefore an object of the invention to condense a gas in a liquid medium. It is further an object of the invention to comminute and disperse a stream of condensing gas in a liquid medium so as to prevent significant gas hammer.

SUMMARY OF THE INVENTION

In accordance with the invention, I have discovered that if a gas, such as steam, is introduced into a vessel containing a liquid medium, such as water, and is passed by means of a conduit into a liquid containment vessel, and gas exiting the conduit by means of an orifice so as to impinge on a plate, the plate being submerged in the liquid medium, the gas impinging on the plate at a sufficiently high velocity that the gas will form a thin sheet of tiny gas bubbles fanning out in all directions prior to substantially condensing in the liquid medium, thereby preventing significant generation of gas hammer such as is normally encountered with a stream of gas condensing in a liquid medium.

DETAILED DESCRIPTION OF THE INVENTION

Figure 1:
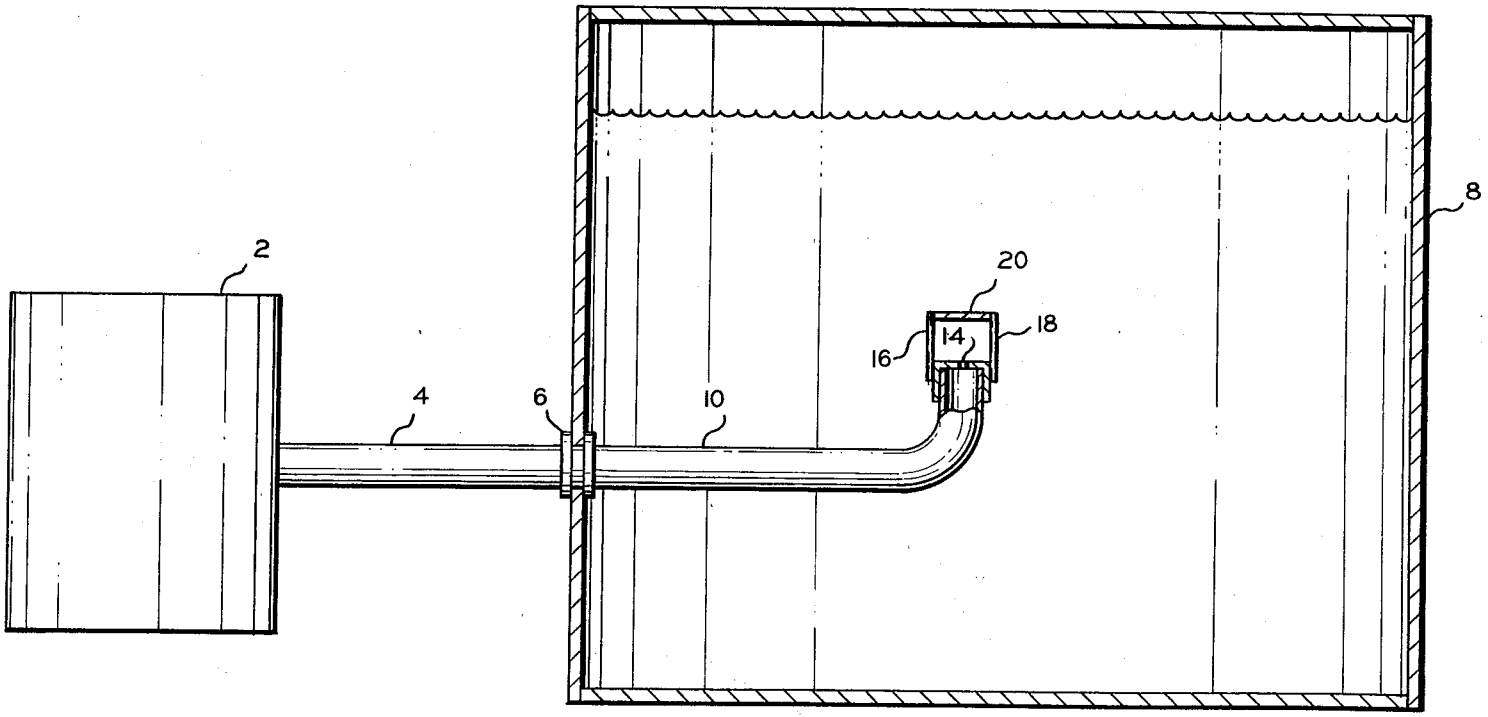
FIG. 1 is a schematic representation of a device for condensing a gas stream in a liquid medium so as to prevent significant generation of gas hammer in a liquid medium.
Figure 2:
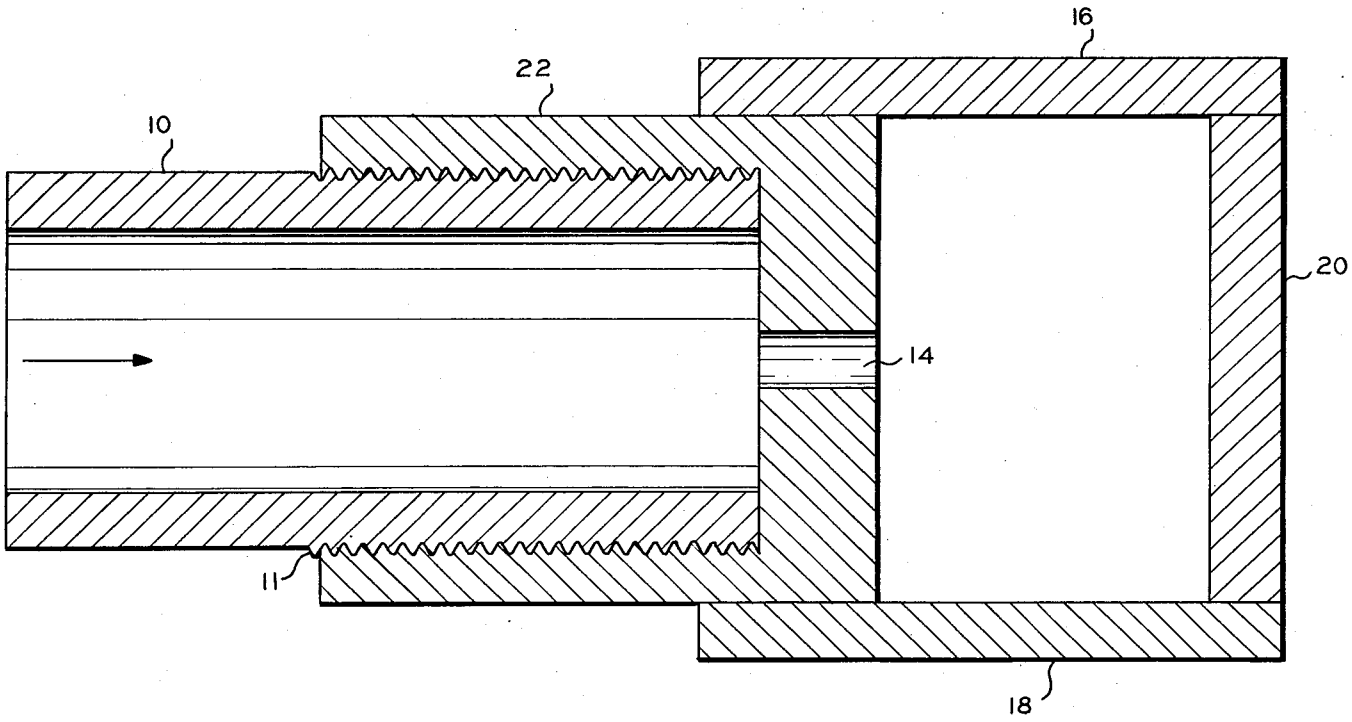
FIG. 2 is a detailed representation of a device for impinging gas against a plate so as to allow the tiny gas bubbles to fan out in a thin sheet before condensing in a liquid medium.

The invention is a method for condensing a gas in a liquid medium which is maintained at conditions at which the gas will condense in the liquid medium. It is further related to a method for condensing a gas-stream in a liquid medium so as to prevent the formation of significant gas hammer in the liquid medium.

Any gas capable of being condensed in a liquid medium at the conditions under which the liquid medium exists may be utilized in the present invention. Particularly suitable gases include but are not limited to steam, ethylene gas and propane gas. Suitable liquid mediums include but are not limited to water, liquid ethylene and liquid propane.

The velocity of the gas impinging on the plate in the present invention can be varied within limits, depending upon the conditions under which the gas is condensing in the liquid medium. The conditions include but are not limited to:

(a) the density of the gas relative to the density of the liquid medium;

(b) the temperature of the gas relative to its condensing temperature;

(c) the diameter of the gas-stream relative to the dimensions of the liquid pool; and (d) the tendency of the plate to be eroded. The velocity of the gas exiting the orifice and impinging the plate must at least be of sufficient velocity to impinge the plate and subsequently fan out in substantially all directions prior to condensing in the liquid medium. The velocity of the gas-stream or the invention method is preferably greater than about 10 ft/sec.

The conduit containing the orifice may be optionally constructed at a suitable angle so as to be positioned in an upward, downward or horizontal direction in the liquid medium. A suitable angle for the direction of the gas-stream exiting the orifice may vary from about 0° to about 45° with respect to a line extending perpendicularly from the plate to the orifice. Further, the gas-impinged plate should be positioned below the level of liquid medium contained in the liquid containment vessel so as to allow substantially complete condensation of the gas in the liquid medium. Preferably, the impinged-plate should be positioned in the central area of the pool of liquid medium in order to minimize disruption of the liquid medium by the condensing gas.

The orifice of the present invention may be the open end of the conduit, or the conduit may contain a nozzle or similar velocity-increasing device for introducing gas into a liquid medium so as to impinge on the plate. The distance from the orifice to the plate may be varied, depending upon the conditions and momentum of the gas condensing in the liquid medium. A suitable distance useful for the invention method would be at least about ¼ the diameter of the orifice. The maximum disin a single system. One way to overcome this problem is to hold the displaced liquid in a vessel that is part of the regeneration system. When the hot gases begin to come through the bed and through the bottom of the vessel, these gases can be bubbled up through the liquid in the holding vessel in order to recover heat and thus conserve energy. (Passing these gases through the same liquid-containing vessel also avoids providing one system for the liquid and a separate system for the gases.) When the gas first starts down through the bed of desiccant, it is cooled by the desiccant and comes out the bottom of the vessel at its condensing point. Thus, when the first flow of these gases contacts the liquid in the holding vessel, these gases condense. Such condensation within the pool of liquid can cause gas hammer of injurious proportions. Under these circumstances the device of the present invention could be applicable and very beneficial to eliminate gas hammer (steam hammer).

As the hot gases continue to enter to dehydrator, they finally warm the entire bed. The gases are then superheated as they contact the liquid in the holding vessel and are not condensed. The hot gases will begin to vaporize some of the liquid in the liquid holding vessel. The device of the present invention is still useful at this stage in the operation to get good contacting of the gases with the liquid, even though it is not as essential as in the first stage.

The examples indicate specific situations in which the present invention's method for condensing a gas stream in a liquid medium so as to prevent the formation of gas hammer would be most useful.

Variation and modification are possible within the scope of the invention as described herein. One skilled in the art in possession of thus disclosure having studied the same will understand that various engineering details of operation are necessarily omitted for sake of simplicity.

We claim:

1. A process for condensing a gas in a liquid medium which is maintained at conditions at which said gas will condense, comprising:

passing said gas through an orifice to produce a high velocity gas-stream;

impinging said high velocity gas-stream against a flat plate disposed in a central area of said liquid medium at such velocity so as to cause said gas-stream to form a thin sheet of tiny gas bubbles fanning out in all directions before substantial condensing of said gas occurs in said liquid medium, thereby reducing gas hammer effects and minimizing disruption of said liquid medium by said gas condensing in said liquid medium.

2. A process in accordance with claim 1 wherein the velocity of said gas-stream impinging on said plate is greater than about 10 ft/sec.

3. A process in accordance with claim 1 wherein said gas-stream impinges on said plate at an angle in the range of about 0° to about 45° with respect to a line perpendicular to said plate.

4. A process for condensing steam in a body of water, comprising:

passing said steam through an orifice to form a high velocity stream of steam; and impinging said high velocity stream of steam against a flat plate disposed in a central area of said body of water at such velocity so as to cause said stream of steam to form a thin sheet of tiny gas bubbles fanning out in all directions before substantial condensing of said steam occurs in said water, thereby reducing steam hammer effects and minimizing disruption of said body of water by said steam condensing in said body of water.

5. A process in accordance with claim 4 wherein the velocity of said stream of steam impinging on said plate is greater than about 10 ft/sec.

6. A process in accordance with claim 4 wherein said stream of steam impinges on said plate at an angle in the range of about 0° to about 45° with respect to a line perpendicular to said plate.

7. A process for condensing a gas in a liquid medium which is maintained at conditions at which said gas will condense, comprising:

passing said gas through an orifice in a transverse wall which closes the end of a gas discharge conduit, wherein the end of said conduit defines an opening of substantially larger cross-section than said orifice, whereby a high velocity gas stream is produced; and impinging said high velocity gas stream against a plate disposed in said liquid medium at such velocity so as to cause said gas stream to fan out in a thin sheet before substantial condensing of said gas occurs in said liquid medium, thereby reducing gas hammer effects.

8. A process in accordance with claim 7 wherein said plate is flat and wherein said thin sheet comprises gas bubbles fanning out in all directions.

9. A process in accordance with claim 8 wherein said gas comprises steam.

10. A process in accordance with claim 9 wherein said liquid medium comprises water.

* * * * *